United States Patent [19]

Westall

[11] 4,448,810

[45] May 15, 1984

[54] TREATING TEXTILE FIBRES WITH QUATERNARY SALT POLYDIORGANOSILOXANE

[75] Inventor: Stephen Westall, Barry, Wales

[73] Assignee: Dow Corning Limited, Barry, Wales

[21] Appl. No.: 434,679

[22] Filed: Oct. 15, 1982

[51] Int. Cl.[3] ..... B05D 3/04; B05D 3/02

[52] U.S. Cl. ..... 427/302; 252/8.8; 427/387; 427/389; 427/389.9; 427/392; 427/393.1; 427/393.2; 427/393.4; 427/412

[58] Field of Search ..... 427/387, 389, 389.9, 427/302, 412, 392, 393.1, 393.4, 393.2; 252/8.8, 8.9

[56] References Cited

U.S. PATENT DOCUMENTS

| | | | |
|---|---|---|---|
| 3,730,701 | 5/1973 | Isquith et al. | 71/67 |
| 4,005,030 | 1/1977 | Heckert et al. | 252/140 |
| 4,005,117 | 1/1977 | Heckert et al. | 252/548 X |
| 4,006,176 | 2/1977 | Heckert et al. | 252/541 X |
| 4,184,004 | 1/1980 | Pines et al. | 427/387 X |
| 4,283,519 | 8/1981 | Pines et al. | 427/387 X |

FOREIGN PATENT DOCUMENTS

| | | |
|---|---|---|
| 1175120 | 12/1969 | United Kingdom . |
| 1367666 | 9/1974 | United Kingdom . |

*Primary Examiner*—Thurman K. Page

*Attorney, Agent, or Firm*—George A. Grindahl

[57] ABSTRACT

Process for the treatment of fibres e.g. of nylon or polyester/cotton in which the fibres are contacted with a polydiorganosiloxane having at least one —OM group, in which M represents H, alkyl or alkoxyalkyl, and at least one quaternary ammonium salt substituent $—RN^+(R'')_2R'X^-$ in which R represents a divalent hydrocarbon or hydrocarbonoxy group, R′ represents a monovalent hydrocarbon group or an alkyleneoxy or polyalkyleneoxy group, each R″ represents methyl or ethyl and X represents a halogen atom.

The treatment facilitates the removal of oily stains during laundering and may be applied in conjunction with other silicones.

5 Claims, No Drawings

TREATING TEXTILE FIBRES WITH QUATERNARY SALT POLYDIORGANOSILOXANE

This invention relates to a process for the treatment of textile fibres and is particularly concerned with improving the soil-release properties of such fibres.

It is known to treat textile fibres to impart resistance to soiling. For example U.K. Pat. No. 1 175 120 discloses that improved antislip, dulling and/or dry-soiling resistance may be imparted to fibrous materials by treatment with a colloidal suspension of a solid silsesquioxane having the unit formula $RSiOH_{1.5}$, wherein 5 to 100 percent of the R groups are substituted hydrocarbon radicals containing from 1 to 7 carbon atoms, wherein the substituents are amino, mercapto, hydroxyl, epoxy, acrylato, methacrylato, cyano or carboxy groups, and up to 95 percent of the R groups are monovalent hydrocarbon radicals having 1 to 7 carbon atoms or halogenated derivatives thereof.

However, in addition to the dry soiling referred to in the said U.K. patent, fibrous materials are also susceptible to soiling by oily materials. For example, during wear articles of clothing can become stained with body secretions and foods. Also, during the processing of fibres, such as in the making up of piece goods, the articles may become stained with machine oil. Such stains are not easily removed especially if removal is not attempted quickly. In some cases removal is made more difficult if the fibres have previously been treated with a silicone, for example to impart certain desirable properties such as lubricity and soft handle. This problem is discussed in U.K. Pat. No. 1 367 666 which discloses a method for improving the soil release properties of fabrics by applying in combination a polymethylsiloxane and a water-soluble polymer of an unsaturated carboxylic acid.

We have now found that the removal of oily soil from textile fibres can be facilitated if the fibres are treated with certain organosiloxanes wherein there are present certain quaternary ammonium salt groups. It is known from U.S. Pat. Nos. 4,005,030, 4,005,117 and 4,006,176 that when metallic or vitreous surfaces are washed with detergent compositions containing quaternary ammonium silanes or siloxane oligomers thereof soil release benefits are imparted to the surface. The benefits obtained are theorised to result from the formation of a thin siloxane coating on the surface. The present invention is, however, concerned with improving the release of such soil from textile fibres which may have thereon an additional siloxane which has been applied for the purpose of obtaining other properties, for example soft handle, lubricity or recovery from creasing.

According to the present invention there is provided a process for the treatment of fibres which comprises applying thereto a polydiorganosiloxane having in the molecule at least one silicon-bonded —OH group, wherein M represents a hydrogen atom, an alkyl group or an alkoxyalkyl group, and at least one silicon-bonded quaternary salt group represented by the general formula $$-\underset{\underset{R''}{|}}{\overset{R''}{\overset{|}{R}}}N^{+}R'X^{-}$$

wherein R represents a divalent group having from 3 to 10 carbon atoms, the said group being composed of carbon, hydrogen and, optionally, oxygen present in the form of ether linkages and/or hydroxyl groups, R′ represents a monovalent hydrocarbon group having from 1 to 15 carbon atoms or the group $(—OQ)_aOZ$, wherein Q represents an alkylene group having 2 or 3 carbon atoms, *a* has a value of from 1 to 20 and Z represents a hydrogen atom, an alkyl group or an acyl group, each R″ represents a methyl group or an ethyl group and X represents a halogen atom, at least 40 percent of the total silicon-bonded substituents in the polydiorganosiloxane being methyl groups and any remaining substituents being monovalent hydrocarbon groups having from 2 to 8 carbon atoms.

The above defined polydiorganosiloxanes which are employed in the process of this invention are linear or substantially linear siloxane polymers having per molecule at least one silicon-bonded —OM group, for example —OH, $—OCH_3$, $—OC_4H_9$ or $—(OCH_2CH_2OCH_3)$, the —OM group preferably having less than about 6 carbon atoms. The —OM groups may be present at any location on the siloxane chain including the terminal silicon atoms. In the general formula of the quaternary salt groups the divalent group R is composed of carbon and hydrogen or carbon, hydrogen and oxygen, any oxygen being present in the form of ether linkages and/or hydroxyl groups. The group R may therefore be, for example, methylene, ethylene, hexylene, xenylene, $—CH_2CH_2OCH_2CH_2—$ and $—(CH_2)_2OCH_2CHOHCH_2—$. Preferably R represents the groups $—(CH_2)_3—$, $—(CH_2)_4—$ or $CH_2CH.CH_3CH_2—$. The R′ group may be any monovalent hydrocarbon group having from 1 to 15 carbon atoms, for example an alkyl group e.g. methyl, ethyl, propyl, butyl or tetradecyl, an alkenyl group e.g. vinyl, or an aryl, alkaryl or aralkyl group e.g. phenyl, naphthyl, tolyl, 2-ethylphenyl, benzyl and 2-phenylpropyl. The R′ group may also be the group $—(OQ)_aOZ$ as hereinabove defined, examples of such groups being $—(OCH_2CH_2)OH$, $—(OCH_2CH_2)_3OH$, $—(OCH_2CH_2)_3(OCH_2CH_2CH_2)_3OC_4H_9$ and $—(OCH_2CH_2)_2OC_3H_7$. Preferably, X represents chlorine or bromine. At least 40% of the total silicone-bonded substituents in the polydiorganosiloxane are methyl groups, any other substituents in addition to the methyl groups, quaternary salt groups and —OM groups being monovalent hydrocarbon groups having from 2 to 8 carbon atoms, e.g. propyl, vinyl or phenyl. For most applications it is preferred that the substituents present in addition to the quaternary salt groups and —OM groups are substantially all methyl groups. At least one of the quaternary salt substituents should be present in the polydiorganosiloxane molecule. The actual proportion of quaternary salt groups for any particular treatment will depend on such factors as the degree of soil resistance desired and on the conditions of application. For example, it may be preferred to employ a polydiorganosiloxane having a high proportion of quaternary salt groups where a low level of pick-up by the fibres is desired, or where the polydiorganosiloxane is employed in conjunction with other silicone treatments as hereinafter described. On the other hand, where properties e.g. lubricity and soft handle, arising from other substituents such as the methyl groups are desired, it may be preferred to employ a higher molecular weight polydiorganosiloxane having a relatively low proportion of the quaternary salt groups.

The polydiorganosiloxanes may be prepared by any suitable method for example by equilibration of the appropriate cyclic siloxanes. They are, however, preferably obtained by the reaction of a silanol-terminated polydiorganosiloxane, e.g. a polydimethylsiloxane, with a silane of the general formula

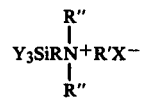

wherein each y represents a monovalent hydrocarbon group, preferably a methyl group, or an alkoxy or alkoxyalkoxy group, preferably having less than 6 carbon atoms, at least two of the Y groups being alkoxy or alkoxyalkoxy, and R, R', R'' and X are as defined hereinabove.

In the performance of the process of this invention the polydiorganosiloxanes may be employed as the sole active component of the coating composition, or they may be applied in conjunction with other substances. For example, the polydiorganosiloxane treating composition may contain catalysts and/or crosslinking agents for effecting or facilitating the fixation, crosslinking or chain extension of the polydiorganosiloxanes on the fibres. Suitable catalysts and cross-linking agents for such reactions are well-known in the art and include, as catalysts, the metal organic compounds e.g., tin carboxylates, titanates and titanium chelates, and as crosslinking agents multi-functional silicon compounds, e.g. alkoxy silanes, partial hydrolysates of alkoxy silanes, oxime silanes and polysiloxanes having SiH groups, for example the poly(methylhydrogen)siloxanes.

We have also found that the benefit of improved oily soil release is obtained when the above-specified quaternary salt polydiorganosiloxanes are employed in conjunction with other organosilicon fibre treatments. Thus, the loss of resistance to oily staining which results from the silicone treatment of fibres can be at least reduced by the use of said polydiorganosiloxanes.

According to a further aspect of this invention therefore there is provided a process for the treatment of fibres wherein the aforesaid polydiorganosiloxanes are applied thereto in conjunction with one or more organosilicon compounds free of the specified quaternary salt groups. Application of the polydiorganosiloxane may take place prior to, simultaneously with or subsequent to the application of the organosilicon compound. Where appropriate, however, it is preferred to avoid the need for two separate treatment stages by applying the polydiorganosiloxane and the organosilicon compound together.

The polydiorganosiloxane may be employed with any of the organosilicon compounds which are applied to fibres to impart desirable properties thereto. Such desirable properties include, for example, those of lubricity, soft handle and crease resistance. The organosilicon compounds may be silanes but are more usually organosiloxanes, particularly the polydiorganosiloxanes in which at least about 50% of the total silicon-bonded substituents are methyl groups any remaining substituents being other monovalent hydrocarbon groups such as the higher alkyl groups, e.g. tetradecyl and octadecyl, phenyl groups, vinyl groups and allyl groups, and monovalent hydrocarbonoxy and substituted hydrocarbon groups, for example alkoxy groups, alkoxyalkoxy groups, fluoroalkyl groups, hydroxyalkyl groups, aminoalkyl and polyamino(alkyl) groups, mercaptoalkyl groups and carboxyalkyl groups. Specific examples of such hydrocarbonoxy and substituted hydrocarbon groups are methoxy, ethoxy, butoxy, methoxyethoxy, 3.3-trifluoropropyl, hydroxymethyl, aminopropyl, beta-aminoethyl-gamma-aminopropyl, mercaptopropyl and carboxybutyl. In addition to the aforementioned organic substituents the organosilicon compound may have silicon-bonded hydroxyl groups, these normally being present in terminal silanol groups in polydiorganosiloxanes, or silicon-bonded hydrogen atoms as in, for example, the poly(methylhydrogen) siloxanes and copolymers of dimethylsiloxane units with methylhydrogensiloxane units and/or dimethylhydrogensiloxane units.

In some cases the organosilicon compound may comprise two or more different types. For example, it may comprise both a silanol-terminated polydimethylsiloxane and a cross-linking agent therefor such as a poly(methylhydrogen)siloxane, an alkoxy silane, e.g. $CH_3Si(OCH_3)_3$ and/or $NH_2CH_2CH_2NH(CH_2)_3Si(OC_2H_5)_3$ or partial hydrolysates and condensates of such silanes. The organosilicon compound may therefore comprise a silane or siloxane which also funtions as a crosslinking agent for the polydiorganosiloxane. Thus any of a wide range of organosilanes and/or organosiloxanes may be employed as the organosilicon treating agent depending on the properties desired in the treated fibres. The use of organosilicon compounds for the treatment of textile fibres is well known and is described for example in British patent specification Nos. 1 011 027, 1 230 779, 1 425 858, 1 429 263, 1 485 769, 1 491 747 and 1 552 359.

The polydiorganosiloxane and the organosilicon compound, separately or as mixtures of the two, can be applied to the fibres employing any suitable application technique, for example by total immersion or by lick roller. They may be applied from an organic solvent carrier, as an aqueous solution or dispersion or as an emulsion.

The proportion of the quaternary salt polydiorganosiloxane employed may vary widely depending on such factors as the degree of soil resistance required, the proportion of quaternary salt groups present therein and the presence or absence of other organosilicon treating agents. Generally, it is preferred to apply from 0.2% to 2% by weight of the polydiorganosiloxane based on the weight of the fibres. However, proportions falling outside this range may be employed if desired. Thus a useful improvement in stain resistance can be obtained by the application of as little as 0.1% by weight of the polydiorganosiloxane, although it is believed that increasing the application level above about 4% by weight does not result in any significant further increase in this property. When the polydiorganosiloxane is applied to the fibres in conjunction with another organosilicon treating agent the relative proportions of the two can vary between wide limits depending on similar factors to those applying to the polydiorganosiloxane alone. It may also depend to some extent on the degree to which the polydiorganosiloxane may contribute to the properties imparted by the organosilicon treating agent. Where such a contribution is possible the proportion of organosilicon treating agent may be reduced and the desired effect restored by increasing the proportion of polydiorganosiloxane. In general, however, the total pick up of polydiorganosiloxane and organosilicon treating agent will not exceed about five or six percent based on the weight of the fibres.

Following the application of the polydiorganosiloxane the fibres may be dried and, where appropriate, the applied composition cured at ambient temperature or by the application of heat. Generally it is preferred to expose the fibres after treatment to temperatures of from about 100° to 200° C.

The process of this invention may be employed to treat a variety of fibres, e.g. cotton, polyester, acrylic and nylon. The fibres may be treated in any form, for example as monofilaments, yarns, random fibres, fabrics and made-up goods. In addition to having improved stain removal properties fibres treated according to this invention usually exhibit a useful improvement in their antistatic properties.

The invention is illustrated by the following examples in which the parts are expressed by weight and Me represents the methyl group.

EXAMPLE 1

A silanol-terminated polydimethylsiloxane having on average about 11 dimethylsiloxy units per molecule (411 parts) and $Me(MeO)_2Si(CH_2)_3N^+Me_2(C_{13}H_{27})Cl^-$ (204 parts) were heated together under nitrogen for 6 hours at 150° C. Volatiles formed during the reaction were removed under reduced pressure. The reaction product was a water-soluble, amber-coloured, liquid polydimethylsiloxane having a methyl group, a methoxy group and a quaternary salt group attached to each terminal silicon atom.

Pieces of de-sized, scoured 65/35% cotton/polyester woven fabric were treated by padding through an aqueous solution of the above-prepared siloxane, $MeSi(OMe)_3$ and dibutyltin di(laurylthioglycollate). The fabric was then dried at 80° C. for 10 minutes and heated to 190° C. for 30 seconds to cure the applied siloxane. Application conditions were such as to deposit on the treated fabric 1% of siloxane, 0.25% $MeSi(OMe)_3$ and 0.06% of tin compound by weight.

The ease with which oily soil could be removed from the treated fabric was evaluated by depositing separately on the fabric pieces 0.5 ml each of melted butter, liquid paraffin, olive oil and mayonnaise. The stains were allowed to set for 18 hours and the soiled fabric pieces then washed in a domestic, automatic washing machine (1800 g load, polyester/cotton programme, 150 g detergent). After tumble drying the degree of soil release was measured by comparison with the AATCC stain release replica (AATCC Test 130:1977). The samples were then subjected to 5 further washes and the soil release test carried out again.

The test results are given in the following table in which the ratings are expressed on a scale of from 1 (no soil release) to 5 (total soil release).

| | Butter | Liquid Paraffin | Olive Oil | Mayonnaise |
|---|---|---|---|---|
| Untreated | 3 | 2.75 | 2.75 | 2.5 |
| Treated | 4 | 3.75 | 3.75 | 3.75 |
| Untreated (5 washes) | 3.25 | 2.75 | 3.5 | 3.5 |
| Treated (5 washes) | 4 | 3.5 | 5 | 4.75 |

Crease recovery angles were measured on the samples according to BS 3086:1972 before and after the 5 wash cycle to yield the following values:

| | 1 wash | Additional 5 washes |
|---|---|---|
| Untreated | 105° | 110° |
| Treated | 120° | 120° |

EXAMPLE 2

The procedure of Example 1 was repeated except that the $MeSi(OMe)_3$ was replaced by a trimethylsiloxy end-stopped polymethylhydrogensiloxane. The concentrations employed were such as to provide a pick up of 2% by weight polydiorganosiloxane, 0.16% by weight polymethylhydrogensiloxane and 0.06% of tin compound. Stain release values after 1 wash were as follows:

| | Butter | Liquid Paraffin | Olive Oil | Mayonnaise |
|---|---|---|---|---|
| Untreated | 3 | 2.75 | 2.75 | 2.5 |
| Treated | 3.75 | 3.5 | 3.75 | 3.25 |

EXAMPLE 3

A quaternary salt-containing polydiorganosiloxane was prepared as in Example 1 except that the polydimethylsiloxane reactant contained an average of about 8 units per molecule. This polydiorganosiloxane (760 parts) and a silanol)terminated polydimethylsiloxane of molecular weight (Mn) of 740 (370 parts) were heated together at 150° C. for 4 hours in the presence of 1% by weight of dibutyltin dilaurate. Volatiles were removed under reduced pressure.

The resulting product was an amber-coloured liquid having a viscosity of 35,000 cS at 250° C. and the theoretical structure

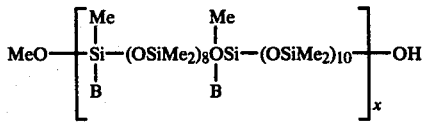

wherein B represents $-(CH_2)_3N^+Me_2C_{13}H_{27}Cl^-$. This copolymer was applied to pieces of 65/35 cotton/polyester fabric (Sample A) in admixture with $MeSi(OMe)_3$ and dibutyltin di(laurylthioglycollate) as described in Example 1, the same siloxane pick up being obtained. For comparison cotton/polyester pieces (Sample B) were similarly treated except that the copolymer was replaced with a silanol-terminated high molecular weight polydimethylsiloxane.

The stain release properties of the samples, together with untreated pieces, were measured as described in Example 1 after being soiled and then subjected to five washes. The following values were obtained:

| | Butter | Liquid Paraffin | Olive Oil | Mayonnaise |
|---|---|---|---|---|
| Untreated | 3.5 | 3 | 3.75 | 3 |
| Sample A | 3.75 | 3.25 | 4.5 | 3.75 |
| Sample B | 3 | 1.5 | 2.5 | 2.25 |

EXAMPLE 4

Pieces of stretch knitted nylon fabric (Sample C) were treated and tested as for the polyester/cotton fabric in Example 1, except that the pick up of the polydiorganosiloxane was adjusted to 2% based on fabric weight. For comparison pieces of the same fabric (Sample D) were treated with a mixture of a silanol-terminated polydimethylsiloxane of M.W.>100,000, a polymethylhydrogensiloxane and the tin compound, the pick-up of each component being 1%, 0.16% and 0.07% by weight respectively. The test results obtained were as follows and show that the untreated stain release of the fibres is substantially retained by the treatment according to this invention. Whereas treatment with the polydimethylsiloxane results in a significant loss of this property.

| | Butter | Liquid Paraffin | Olive Oil | Mayonnaise |
|---|---|---|---|---|
| Untreated | 5 | 5 | 5 | 5 |
| Sample C | 3.5 | 5 | 5 | 5 |
| Sample D | 1 | 1 | 2.5 | 1.5 |

EXAMPLE 5

A natural scoured 65/35% polyester/cotton fabric was treated by padding through an aqueous emulsion of the reaction product of an $\alpha$, $\omega$ silanol-terminated polydimethylsiloxane having a molecular weight of approximately 40,000 (1000 parts) and the silane $Me(MeO)_2Si(CH_2)_3NH(CH_2)_2NH_2$ (7 parts) to give 2% silicone add-on. The treated fabric (Sample E) was heated at 150° C. for 3 minutes to dry the fabric and cure the siloxane.

Similar pieces of fabric were treated as described above except that the treating emulsion also contained the quaternary salt polydiorganosiloxane of Example 1 in an amount equal to the amino-siloxane. Application was by padding to give a total silicone add-on of 2% by weight. The pieces were designated Sample F.

The stain release properties of Samples E and F together with untreated pieces (Sample G) were evaluated as described in Example 1.

| | Butter | Liquid Paraffin | Olive Oil | Mayonnaise |
|---|---|---|---|---|
| Sample E | 3 | 3 | 3.25 | 3.25 |

-continued

| | Butter | Liquid Paraffin | Olive Oil | Mayonnaise |
|---|---|---|---|---|
| Sample F | 4.3 | 4.5 | 4.5 | 4.5 |
| Sample G | 3 | 3 | 3 | 3 |

That which is claimed is:

1. A process for the treatment of fibres which comprises applying thereto a polydiorganosiloxane having in the molecule at least one silicon-bonded —OM group, wherein M represents a hydrogen atom, an alkyl group or an alkoxyalkyl group, and at least one silicon-bonded quaternary salt group represented by the general formula $$-\overset{\overset{R''}{|}}{\underset{\underset{R''}{|}}{R}}N^{+}R'X^{-}$$

wherein R represents a divalent group having from 3 to 10 carbon atoms, the said group being composed of carbon, hydrogen and, optionally, oxygen in the form of ether linkages and/or hydroxyl groups, R' represents a monovalent hydrocarbon group having from 1 to 15 carbon atoms or the group $(—OQ)_aOZ$, wherein Q represents an alkylene group having 2 or 3 carbon atoms, $a$ has a value from 1 to 20 and Z represents a hydrogen atom, an alkyl group or an acyl group, each R'' represents methyl or an ethyl group and X represents a halogen atom, at least 40 percent of the total silicon-bonded substituents in the polydiorganosiloxane being methyl groups and any remaining substituents being monovalent hydrocarbon groups having from 2 to 8 carbon atoms.

2. A process as claimed in claim 1 wherein M represents a hydrogen atom or an alkyl group having less than 6 carbon atoms.

3. A process as claimed in claim 1 wherein the polydiorganosiloxane has been prepared by the reaction of a silanol-terminated polymethylsiloxane and a silane represented by the general formula $$Y_3Si\overset{\overset{R''}{|}}{\underset{\underset{R''}{|}}{R}}N^{+}R'X^{-}$$

wherein each Y represents a methyl group or an alkoxy or alkoxyalkoxy group having less than 6 carbon atoms, not more than one Y being methyl.

4. A process as claimed in claim 1 wherein the polydiorganosiloxane is applied prior to, simultaneously with or subsequent to treatment of the fibres with one or more organosilicon compounds free of the specified salt groups.

5. A process as claimed in claim 4 wherein the organosilicon compound functions as a crosslinking agent for the polydiorganosiloxane and is applied to the fibres simultaneously therewith.

* * * * *

UNITED STATES PATENT AND TRADEMARK OFFICE

CERTIFICATE OF CORRECTION

PATENT NO. : 4,448,810

DATED : May 15, 1984

INVENTOR(S) : Stephen Westall

It is certified that error appears in the above-identified patent and that said Letters Patent is hereby corrected as shown below:

In column 1, line 64, "-OH" should read -- OM --.

Signed and Sealed this

*Nineteenth* Day of *February 1985*

[SEAL]

*Attest:*

DONALD J. QUIGG

*Attesting Officer* *Acting Commissioner of Patents and Trademarks*